US009010337B2

(12) United States Patent
Kobal

(10) Patent No.: US 9,010,337 B2
(45) Date of Patent: Apr. 21, 2015

(54) SMOKING ARTICLE WITH FLAVOR DELIVERY SYSTEM

(75) Inventor: Gerd Kobal, Sandy Hook, VA (US)

(73) Assignee: Philip Morris USA Inc., Richmond, VA (US)

( * ) Notice: Subject to any disclaimer, the term of this patent is extended or adjusted under 35 U.S.C. 154(b) by 971 days.

(21) Appl. No.: 13/071,636

(22) Filed: Mar. 25, 2011

(65) Prior Publication Data

US 2012/0017927 A1 Jan. 26, 2012

Related U.S. Application Data

(60) Provisional application No. 61/318,263, filed on Mar. 26, 2010.

(51) Int. Cl.

| | |
|---|---|
| ***A24D 3/06*** | (2006.01) |
| ***A24B 15/28*** | (2006.01) |
| ***A24D 1/02*** | (2006.01) |

(52) U.S. Cl.

CPC ..... *A24B 15/283* (2013.01); *A24D 1/02* (2013.01); *A24D 3/061* (2013.01)

(58) Field of Classification Search

None

See application file for complete search history.

(56) References Cited

U.S. PATENT DOCUMENTS

| | | | | |
|---|---|---|---|---|
| 2,803,376 | A * | 8/1957 | Kampff | 221/88 |
| 3,602,235 | A | 8/1971 | Dock | |
| 4,114,629 | A | 9/1978 | Sedlacek et al. | |
| 4,687,008 | A | 8/1987 | Houck, Jr. et al. | |
| 4,696,314 | A | 9/1987 | Kallianos et al. | |
| 4,717,017 | A | 1/1988 | Sprinkel, Jr. et al. | |
| 4,720,423 | A | 1/1988 | Fraser | |
| 4,889,144 | A | 12/1989 | Tateno et al. | |
| 5,186,185 | A | 2/1993 | Mashiko et al. | |
| 5,472,002 | A | 12/1995 | Covarrubias | |
| 5,595,196 | A | 1/1997 | Salonen et al. | |
| 6,164,444 | A | 12/2000 | Bray et al. | |
| 6,612,429 | B2 | 9/2003 | Dennen | |
| 6,761,174 | B2 | 7/2004 | Jupe et al. | |
| 7,789,089 | B2 | 9/2010 | Dube et al. | |
| 7,810,508 | B2 | 10/2010 | Wyss-Peters et al. | |
| 2003/0014947 | A1 | 1/2003 | Deevi | |
| 2007/0095357 | A1 | 5/2007 | Besso et al. | |

OTHER PUBLICATIONS

International Search Report and Written Opinion mailed Aug. 29, 2011 for PCT/IB2001/000991.

* cited by examiner

*Primary Examiner* — Michael J Felton

(74) *Attorney, Agent, or Firm* — Buchanan Ingersoll & Rooney PC

(57) ABSTRACT

A flavor delivery release system for a cigarette or cigarette package. The system includes a cigarette, at least one capsule containing a flavorant, the capsule positioned on an external surface of the cigarette; and wherein the flavorant is released upon rupturing the capsule.

7 Claims, 3 Drawing Sheets

SMOKING ARTICLE WITH FLAVOR DELIVERY SYSTEM

CROSS REFERENCE TO RELATED APPLICATION

This application claims priority under 35 U.S.C. §119(e) to U.S. Provisional Application No. 61/318,263, filed on Mar. 26, 2010, the entire content of which is incorporated herein by reference thereto.

WORKING ENVIRONMENT

Smoking articles, particularly cigarettes, generally comprise a tobacco rod of shredded tobacco (usually, in cut filler form) surrounded by a paper wrapper, and a cylindrical filter aligned in an end-to-end relationship with the tobacco rod. The filter preferably includes a plug of cellulose acetate tow attached to the tobacco rod by tipping paper. Ventilation of mainstream smoke is achieved with a row or rows of perforations about a location along the filter.

Cigarette packages perform the functions of containing a pre-selected bundle of cigarettes and protecting the cigarettes from mechanical and environmental damage. In addition, a package protects the freshness of the cigarettes, which deteriorates with exposure to air.

Cigarette packages are preferably made from paper into the so-called soft package that tears open on a top panel, and from paperboard into the so-called hard package that preferably includes an integral reclosable lid. Both types of package preferably include a foil or foil laminate wrapped about a bundle of cigarettes, and an outer sealed wrapper of plastic film, typically polypropylene. The foil bundle wrap and the outer wrapper help maintain the freshness of the packaged cigarettes.

Encapsulation is a process by which a core material is captured within a second material (encapsulate) or capsule. Aromas and flavors can be encapsulated in capsules of varying sizes so that the flavor is preserved until the rupture of the capsule by mechanical or other force. Preservation of aromas and flavors within the capsule assures that upon release of the flavor it is consistently as strong as when it was first encapsulated.

SUMMARY

In accordance with one embodiment, a smoking article includes a cigarette comprising a tobacco rod and a filter. The filter includes a ventilation hole and at least one capsule containing a flavorant. The capsule is positioned on an external surface of the cigarette. The flavorant is released upon rupture of the capsule and the capsule positioned such that the released flavorant is drawable into said cigarette through the ventilation hole.

In accordance with another embodiment, a tobacco product includes a cigarette, a cigarette packaging adapted to contain the cigarette, and at least one capsule containing a flavorant. The cigarette includes a filter, a tobacco rod, a tipping paper and a ventilation hole at a location along the tipping paper. The capsule is positioned on an outer surface of the cigarette and is adjacent the ventilation hole. The flavorant is released by removing the cigarette from said cigarette packaging.

In accordance with a further embodiment, a flavor delivery system for a cigarette includes a cigarette package and at least one cigarette within the cigarette package. The at least one cigarette includes at least one capsule containing a flavorant. The capsule is positioned on an external surface of the cigarette. The flavorant is released upon rupture of the capsule.

In accordance with another embodiment, a method of treating mainstream smoke with an agent includes the steps of: locating an encapsulated form of an agent adjacent a ventilation hole of a smoking article; releasing the agent by rupturing the encapsulated form of the agent; and contacting the mainstream smoke with the agent by drawing the released agent through the ventilation hole.

BRIEF DESCRIPTION OF THE DRAWING FIGURES

DETAILED DESCRIPTION

Figure 1:
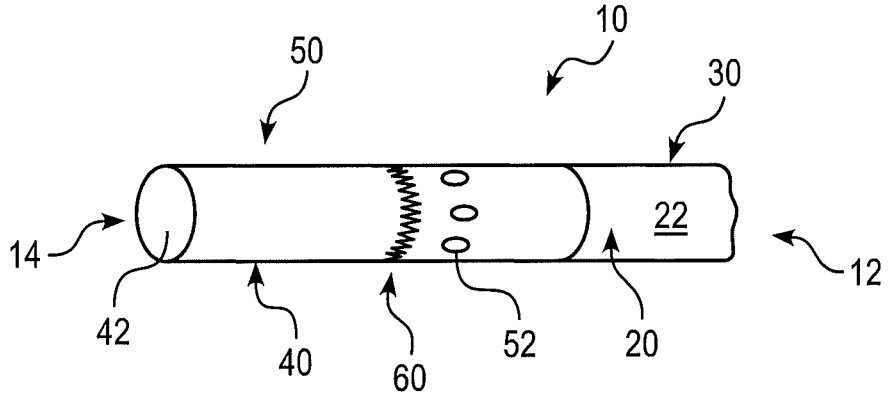
FIG. 1 is a perspective view of a cigarette.

As shown in FIG. 1, a cigarette 10 includes a rod 20 of smokable material 22, such as tobacco cut filler, contained in a circumscribing wrapping material 30. The rod 20 is typically referred to as a "tobacco rod" and has a lit end 12 and a tipped end at which the filter 40 is attached to the tobacco rod 20.

The filter 40 includes a filter material 42 (e.g., starch-based, polypropylene, or plasticized cellulose acetate tow), usually circumscribed by a plug wrap. The filter material 42 also can have the form of a gathered web (e.g., polypropylene web, polyester web, cellulosic or starch-based web). If desired, the filter material 42 can have at least one cavity, sleeve, sorbent, passage or groove (not shown) extending longitudinally therethrough or partially therethrough. The plug wrap may optionally incorporate a carbonaceous material. The plug wrap may circumscribe the total length of the filter 40.

The filter 40 is attached to the tobacco rod 20 by tipping paper 50 which circumscribes the filter 40 and an adjacent region of the tobacco rod 20. The tipping paper 50 is typically constructed of a paper web, but any suitable material can be used. A ventilated or air diluted smoking article is provided with an air dilution means, such as a series of ventilation holes or perforations 52, each of which extend through the tipping paper 50 and optionally the plug wrap.

As shown in FIG. 1, the cigarette 10 also includes at least one flavorant 60 at a location adjacent to the ventilation holes 52 such that the flavorant 60 can be drawn with air into the cigarette 10 through the ventilation holes 52 of the tipping paper 50. It can be appreciated that by positioning the flavorant 60 between the ventilation holes 52 and the mouth (buccal) end 14 of the cigarette 10, it is not combusted nor is it heated during smoking of the cigarette 10. Furthermore, there is little to no change in the chemistry of the flavorant 60 during smoking of the cigarette 10.

Figure 2:
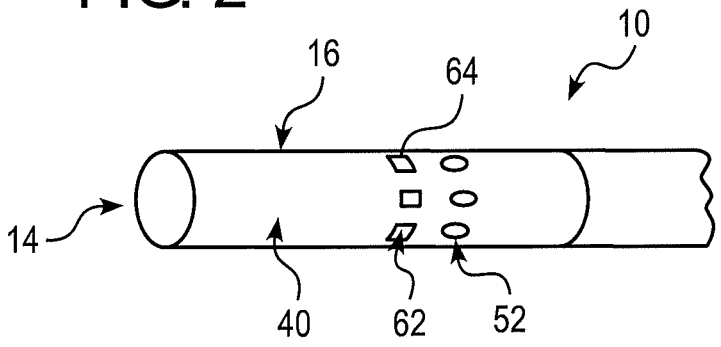
FIG. 2 is a perspective view of the cigarette of FIG. 1 having a flavor delivery system.
Figure 3:
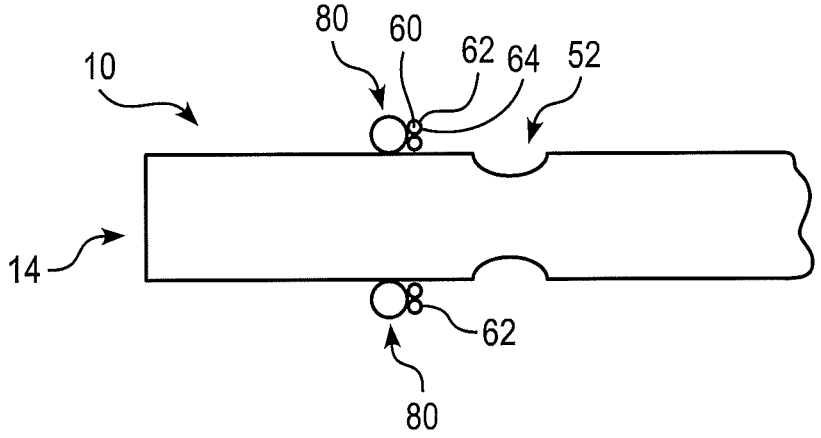
FIG. 3 is a cross sectional view of a cigarette having a collar adapted to release a flavorant.
Figure 4:
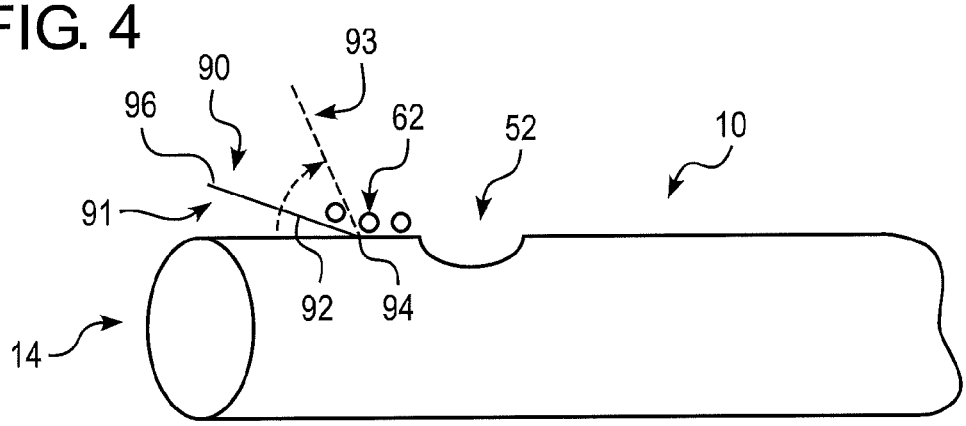
FIG. 4 is a cross sectional view of a cigarette having a latch system adapted to release a flavorant.
Figure 7:
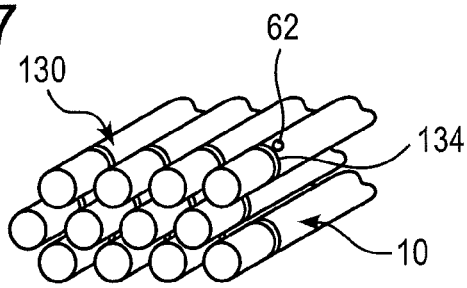
FIG. 7 is a perspective view of a cigarette holder for a flavor delivery system for cigarettes.

FIG. 2 shows a cigarette 10 having a plurality of capsules 62 (e.g., microbeads in the form of a continuous or discontinuous film) located on an external surface 16 of the cigarette 10. The plurality of capsules 62 can be attached via an adhesive film or other suitable material or composition to the cigarette 10. The plurality of capsules 62 can be attached to the outer surface 16 of the cigarette 10 as shown in FIG. 2, or closely attached to each individual cigarette 10 on a paper collar 80 (as shown in FIG. 3), on a latch system (as shown in FIG. 4), a grid system (as shown in FIG. 7) or any other suitable arrangement. By removing the cigarette 10 from a cigarette package 100, the flavorant 60 is released. Preferably, kinetic energy in the form of frictional contact ruptures or alters the configuration of the capsules 62 releasing the flavorant 60.

The capsules 62 comprise a flavorant 60 encapsulated in an outer shell (e.g., layer of encapsulating material) 64. The composition of the outer shell 64 of the capsule 62 can be paraffin, a polyvinyl alcohol, a mixture of vinyl acetate and algin, or any other suitable material. It can be appreciated that a multitude of processes exist for manufacturing the capsules 62. Accordingly, the capsules 62 can include varying size and shape, differing resistance to kinetic forces and can include alternative capsule compositions and capsule constituents.

The capsule 60 diameter can vary from about 10 microns to about 2,500 microns, with microcapsules ranging in size from about 5 microns to about 80 microns in diameter. In addition, the rupture force can vary from about 15 grams to about 1200 grams depending on the composition of the outer shell 64.

The capsules 62 contain the flavorant 60, which can be an aroma of choice, such as menthol, peppermint, coconut, roasted, and/or toasted aromas. However, almost any flavor oil or composition can be encapsulated so long as it meets certain basic requirements of the technology. In addition, the concentration of flavorant 60, within each capsule can be adjusted or modified to provide the desired amount of flavorant 60. Thus, the concentration of the flavorant 60, within each capsule 62 can be the same or can vary depending on the desired aroma.

As shown in FIG. 2, each cigarette 10 can include a plurality of capsules 62, which surround the cigarette 10. Each of the capsules 62 can contain the same flavorant 60, or alternatively, each of the capsules 62 can contain a different flavorant 60. In addition, each capsule 62 can include varying amounts of flavorant 60 depending on the desired aroma. It can be appreciated that by varying the flavorant 60 within a plurality of capsules 62, upon rupturing the outer shell 64 of the capsule 62, any desired aroma or flavor can be obtained.

The capsules 62 preferably release the flavorant 60 by kinetic energy, when each of the individual cigarettes 10 within the cigarette package (FIGS. 5 and 6) are removed from the cigarette package 100. The mechanical forces generated through friction between the outer surface 16 of the cigarette 10 through the collar 80 (FIG. 3), the latch system (FIG. 4) or a grid system 70 (FIG. 7) rupture or alter the capsule 62, such that the flavorant 60 is released from the environment of the capsules 62 and into the atmosphere in the vicinity of the ventilation holes 52.

FIG. 3 shows a cross sectional view of a cigarette 10 having a collar 80. The collar 80 is positioned around the tipping paper 50. The collar 80 can be a ring or round flange positioned around the tipping paper 50. The collar 80 is preferably made of a paper like material; however, any suitable materials can be used.

As shown in FIG. 3, a plurality of flavorant capsules 62 are positioned between the collar 80 and the ventilation holes 52. The plurality of capsules 62 are preferably positioned on the mouth end 14 of the ventilation holes 52 of the cigarette 10. The capsules 62 can be arranged in a single row or stacked upon one another as shown in FIG. 3. It can be appreciated that the capsules 62 can be located in any number of configurations including a single row of capsules 62 or multiple rows of capsules 62 having a single layer or multiple layers of capsules 62.

As the cigarette 10 is removed from the package 100 (FIG. 5), the collar 80 ruptures the capsules 62, such that the flavorant 60 is released from the environment of the capsules 62 and into the atmosphere in the vicinity of the ventilation holes 52.

FIG. 4 shows a cross sectional view of a cigarette 10 having a flavor releasing latch system 90. As shown in FIG. 4, the cigarette 10 includes a latch system 90 having a fold of paper 92 positioned adjacent to the ventilation holes 52 of the tipping paper 50. The fold of paper 92 extends from a vicinity of the ventilation holes 52 towards the mouth end 14 of the cigarette 10. The fold of paper 92 is preferably attached to a first end 94 in the vicinity of the ventilation holes 52 and a free end 96 extends towards the mouth end 14 of the cigarette 10. At least one capsule 62 is positioned on or near the first end 94 of the fold of paper 92. As the cigarette 10 is removed from the cigarette package 100, the fold of paper 92 moves from a first position 91 to a second position 93, wherein the movement or unfolding of the fold of paper 92, causes the capsules 62 to rupture or break, releasing the flavorant 60.

Figure 5:
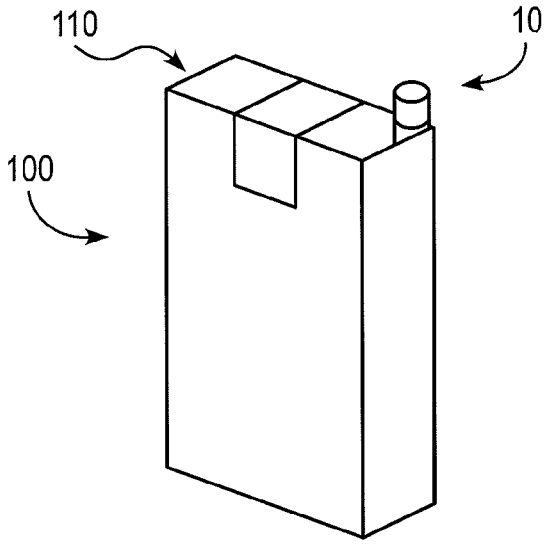
FIG. 5 is a perspective view of a cigarette package.
Figure 6:
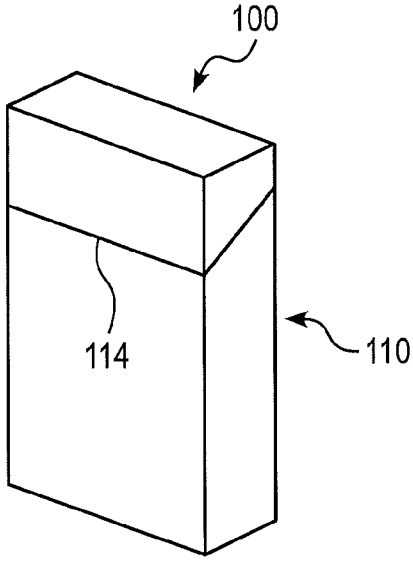
FIG. 6 is a perspective view of a cigarette package.

FIG. 5 shows a perspective view of a cigarette package 100. The cigarette package 100 (soft package) comprises an outer box 110 and a bundle of cigarettes 10 (not shown) inserted within the outer box 110. Alternatively, the cigarette package 100 can be a hinge lid box cigarette package as shown in FIG. 6, which preferably comprises an outer box 110, an inner frame and a bundle of cigarettes 10. The hinge lid box preferably includes a hinged lid 114. The hinged lid 114 can open from the front with a hinged back panel (as shown in FIG. 6) or from the side with a hinged left panel or right panel. The bundle of cigarettes 10 are preferably wrapped in a foil bundle wrap.

FIG. 7 shows a perspective view of a grid system 130 adapted to fit within the outer box 110 of the cigarette package 100. The grid system 130 is preferably constructed of a plastic, paper or other suitable material. The grid system 130 further comprises a plurality of mechanical elements 134 such as a collar, a latch or other suitable devices, which are adapted to rupture the capsule 62 as the cigarettes 10 are removed from the cigarette package 100. The mechanical elements 134 apply a mechanical force to the plurality of capsules 62 as the individual cigarettes 10 are removed, which ruptures the capsule 62 releasing the flavorant 60.

Figure 8:
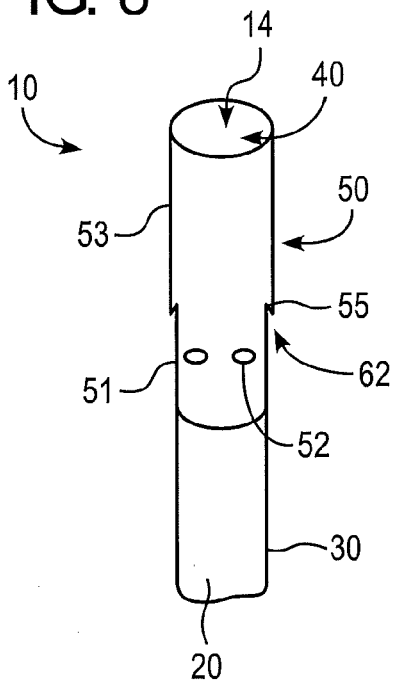
FIG. 8 is a cross sectional view of a flavor delivery system for a cigarette.
Figure 9:
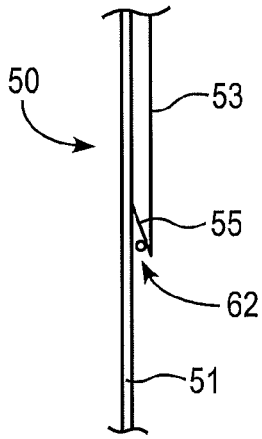
FIG. 9 is a cross sectional view of a flavor delivery system for a cigarette of FIG. 8.

FIGS. 8 and 9 show cross sectional views of another embodiment of a flavor system for a cigarette 10. As shown in FIGS. 8 and 9, the cigarette 10 comprises the tobacco rod 20, the cigarette wrapper 30, the filter 40, and tipping paper 50. The tipping paper 50 comprises an inner layer 51 and an outer layer 53. The outer layer 53 extends from the mouth end 14 of the cigarette 10 to vicinity of the ventilation holes 52 located in the inner layer 51 of the tipping paper 50. The outer layer 53 of the tipping paper 50 near the ventilation holes 52 further includes an angled edge portion 55 (e.g., a fold in the tipping paper 50). The angled edge portion 55 is configured to receive one or more flavorant capsules 62. The flavorant capsule 62 is positioned between an outer surface of the inner layer 51 and an inner surface of the outer layer 53 (e.g., the microbeads/ microcapsules are located on at least one of the facing surfaces of the folded over tipping paper). As the cigarette 10 is removed from the cigarette package 100, a mechanical force from either the package 100 or from the act of removing the cigarette ruptures the capsule 62 releasing the flavorant 60 (e.g., as the folded tipping paper is unfolded the microbeads/microcapsules are ruptured to release volatile constituents of the flavorant into the surrounding air). It can be appreciated that the capsules 62 can also be ruptured by the smoker's handling of the cigarette 10.

Figure 10:
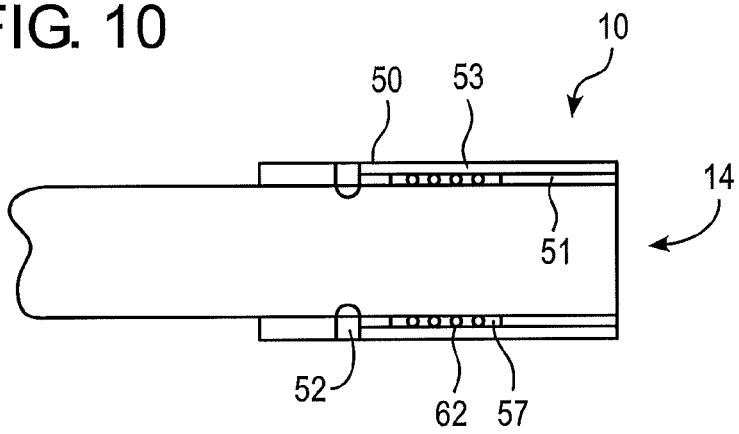
FIG. 10 is a cross sectional view of a flavor delivery system for a cigarette.

FIG. 10 shows a cross sectional view of a further embodiment of a flavor system for a cigarette 10. As shown in FIG. 10, the tipping paper 50 of the cigarette 10 comprises an inner layer 51 and an outer layer 53. The inner layer 51 includes a recessed portion 57 adapted to receive at least one flavorant capsule 62. The recessed portion 57 is preferably positioned between the ventilation holes 52 of the inner layer 51 of tipping paper 50 and the mouth end 14 of the cigarette 10. The recessed portion 57 receives the capsules 62 which can be ruptured during removal of the cigarette 10 from the cigarette package 100 by any suitable kinetic or mechanical force, or alternatively, the capsules 62 can be ruptured by the smoker before lighting the cigarette 10 or after the cigarette 10 is lit by applying a force to the cigarette 10 between the ventilation holes 52 and the mouth end 14.

Figure 11:
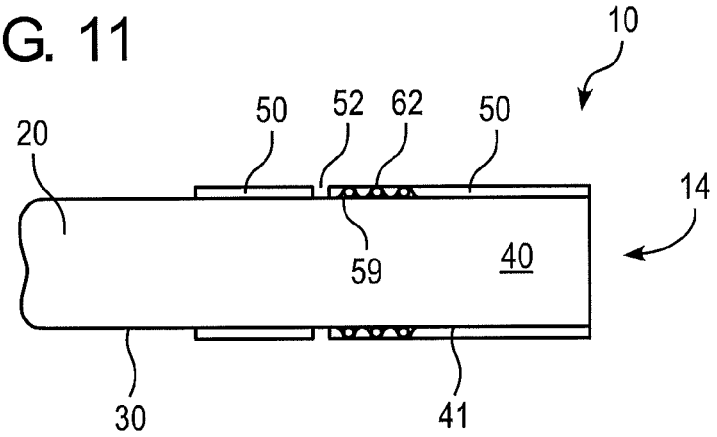
FIG. 11 is a cross sectional view of a further embodiment of a flavor delivery system for a cigarette.

FIG. 11 shows a further embodiment of a cigarette 10 with a flavor delivery system. The cigarette comprises the tobacco rod 20, the cigarette wrapper 30, the filter 40, and tipping paper 50. At least one flavorant capsule 62 can be placed between an outer surface 41 of the plug wrap of the filter 40 and an inner surface 59 of the tipping paper 50. The flavorant capsules 62 are preferably positioned between the ventilation holes 52 of the tipping paper 50 and the mouth end 14 of the cigarette 10. The capsules 62 can be ruptured during removal of the cigarette from the cigarette package 100 or by the handling of the cigarette 10 before the cigarette 10 is lit or after the cigarette 10 is lit.

Although the methods, apparatuses and packaging has been described in terms of the preferred embodiments thereof, it will be appreciated by those skilled in the art that additions, deletions, modifications, and substitutions not specifically described can be made without departing from the spirit and scope of the embodiments as defined in the appended claims.

What is claimed is:

1. A smoking article comprising:

a cigarette comprising a tobacco rod and a filter, said filter including a ventilation hole;

at least one capsule containing a flavorant, the capsule positioned on an external surface of the cigarette; and a collar positioned on the external surface of the cigarette beside the at least one capsule, the collar configured to rupture the capsule upon removal of the cigarette from a cigarette package by contact of the collar and the capsule, wherein the flavorant is released upon rupture of the capsule, the capsule is positioned such that the released flavorant is drawable into said cigarette through said ventilation hole, wherein the collar is a ring or round flange.

2. The smoking article of claim 1, further comprising a film containing a plurality of capsules positioned around the external surface of the cigarette.

3. The smoking article of claim 1, wherein the capsule is adjacent to a plurality of ventilation holes within a tipping material positioned on a mouth end of the cigarette and wherein the flavorant is located between the plurality of ventilation holes and the mouth end of the cigarette.

4. The smoking article of claim 1, comprising at least two capsules, wherein the at least two capsules contain the same flavorant or a different flavorant.

5. A smoking article comprising:

a cigarette comprising a tobacco rod and a filter, said filter including a ventilation hole;

at least one capsule containing a flavorant, the capsule positioned on an external surface of the cigarette; and a latch system comprising a fold of paper positioned on the external surface of the cigarette adjacent the capsule, the fold of paper attached at a first end adjacent the ventilation hole and having a free end extending towards a mouth end of the cigarette, the fold of paper configured to move from a first position to a second position upon removal of the cigarette from a cigarette package by unfolding the fold of paper so as to rupture the capsule, wherein the flavorant is released upon rupture of the capsule and the capsule is positioned such that the released flavorant is drawable into the cigarette through the ventilation hole.

6. The smoking article of claim 1, wherein the collar is configured to rupture the capsule from contact and a mechanical force from an action of removing the smoking article from a cigarette package.

7. The smoking article of claim 1, wherein the collar is configured to rupture the capsule from contact with a cigarette package during removal of the smoking article form the cigarette package.

* * * * *